United States Patent [19]

Holmquist et al.

[11] Patent Number: 4,793,903

[45] Date of Patent: Dec. 27, 1988

[54] METHOD OF CLEANING ALUMINUM SURFACES

[75] Inventors: Howard W. Holmquist, Kirkland; Larry E. Tarr, Seattle, both of Wash.

[73] Assignee: The Boeing Company, Seattle, Wash.

[21] Appl. No.: 923,086

[22] Filed: Oct. 24, 1986

[51] Int. Cl.[4] ..... C25D 5/44

[52] U.S. Cl. ..... 204/33; 204/129.95

[58] Field of Search ..... 204/129.95, 35.1, 33

[56] References Cited

U.S. PATENT DOCUMENTS

| | | | |
|---|---|---|---|
| 2,553,937 | 5/1951 | Patrie | 204/129.95 |
| 2,708,655 | 5/1955 | Turner | 204/140.5 |
| 2,721,835 | 10/1955 | Axtell | 204/38 |
| 3,041,259 | 6/1962 | Stoddard, Jr. | 204/141 |
| 3,260,660 | 7/1966 | Brooks | 204/129.95 |
| 3,844,908 | 10/1974 | Matsuo et al. | 204/35 |
| 3,915,811 | 10/1975 | Tremmel et al. | 204/33 |
| 4,022,671 | 5/1977 | Asada | 204/42 |
| 4,025,681 | 5/1977 | Donnelly et al. | 428/116 |
| 4,085,012 | 4/1978 | Marceau et al. | 204/38 A |
| 4,097,342 | 6/1978 | Cooke et al. | 204/28 |
| 4,127,451 | 11/1978 | Marceau et al. | 204/38 |
| 4,279,715 | 7/1981 | Arora et al. | 204/129.95 |
| 4,440,606 | 4/1984 | Powers et al. | 204/33 |
| 4,448,647 | 5/1984 | Gillich et al. | 204/33 |
| 4,452,674 | 6/1984 | Gillich et al. | 204/33 |

FOREIGN PATENT DOCUMENTS 2360051 2/1978 France .

*Primary Examiner*—R. L. Andrews

*Attorney, Agent, or Firm*—Joan H. Pauly

[57] ABSTRACT

An aluminum alloy article is anodized in an aqueous solution of phosphoric acid. Oxide forms on the surfaces of the article and dissolves as it forms to displace contaminants and deoxidize the surfaces. The anodizing etch rate is from about 0.0002 to about 0.0005 inch/surface/hour. Residual oxide on the surfaces is a maximum of about 3000 Angstroms. The article may be left in the solution following anodizing to dissolve a portion of the residual oxide. Preferred anodizing parameters include 15 to 25% by weight phosphoric acid, 75° to 95° F., and 4 to 10 volts. Usual anodizing times are from 5 to 10 minutes. Following deoxidation, the article is ready for subsequent processing, such as anodizing to provide a controlled thickness porous oxide coating followed by adhesive bonding.

14 Claims, 4 Drawing Sheets

20% PHOSPHORIC ACID
5 Volt - 60 Sec Ramp - 10 Min Anodize Time

| Alloy | Solution T (°F) | Etch Rate (Inch/Surf./Hour) | Initial Current Density (A/ft$^2$) | Final Current Density (A/ft$^2$) |
|---|---|---|---|---|
| 2024 Clad | 70 | .000024 | 1.2 | 1.4 |
| | 75 | .000054 | 1.5 | 1.5 |
| | 80 | .000086 | 2.1 | 2.1 |
| | 85 | .000122 | 2.8 | 2.6 |
| | 90 | .000151 | 3.7 | 3.5 |
| | 95 | .000202 | 4.9 | 4.5 |
| | 100 | .000264 | 6.4 | 5.6 |
| 2024 Bare | 70 | .000074 | 3.6 | 3.2 |
| | 75 | .000093 | 3.8 | 3.4 |
| | 80 | .000130 | 6.0 | 4.9 |
| | 85 | .000163 | 7.4 | 5.8 |
| | 90 | .000197 | 7.4 | 7.0 |
| | 95 | .000241 | 8.5 | 8.1 |
| | 100 | .000303 | 10.6 | 9.8 |
| 7075 Bare | 70 | .000084 | 2.4 | 2.0 |
| | 75 | .000106 | 2.6 | 2.3 |
| | 80 | .000142 | 3.6 | 3.2 |
| | 85 | .000191 | 4.8 | 4.1 |
| | 90 | .000232 | 5.8 | 5.2 |
| | 95 | .000287 | 7.3 | 6.5 |
| | 100 | .000358 | 8.5 | 7.8 |

Fig. 3

90°F, 20% $H_3PO_4$, 5 VOLTS

| SOLUTION CONDITION | ALLOY | ETCH RATE X $10^5$ (INCH/SURFACE/HOUR |
|---|---|---|
| FRESH | 2024 BARE | 19.7 |
| | 2024 CLAD | 15.1 |
| | 7075 BARE | 23.2 |
| AGED | 2024 BARE | 20.2 |
| | 2024 CLAD | 16.0 |
| | 7075 BARE | 25.5 |

METHOD OF CLEANING ALUMINUM SURFACES

TECHNICAL FIELD

This invention relates to methods for cleaning aluminum surfaces and, more particularly, to such a method in which an aluminum article is anodized in a phosphoric acid solution with a controlled etch rate to form an oxide on the surfaces of the article and dissolve the oxide as it forms to deoxidize and displace contaminants from the surfaces.

BACKGROUND ART

In the manufacture of aluminum alloy structures, there are a number of important processes, such as adhesive bonding and anodizing, which require that the aluminum surfaces be free from contaminants and undesirable oxidation at the beginning of the process. Since the initial handling of alloy stock almost invariably results in contamination and/or oxidation of the surfaces, aluminum alloy articles that are to be subjected to these processes must be cleaned prior to the processes. One type of process that requires a clean aluminum alloy article is phosphoric acid anodizing to form a controlled aluminum oxide coating suitable as a base for an adhesive bond. An example of this type of process is disclosed in U.S. Pat. No. 4,085,012, granted Apr. 18, 1978, to J. A. Marceau et al. The Marceau et al. process and similar processes require preliminary cleaning nd deoxidation to provide a clean surface with a controlled oxide composition for the anodizing process to ensure the proper formation of the aluminum oxide coating and, thereby, ensure the quality of the adhesive bond.

The cleaning and deoxidizing procedures that are currently in use present a number of serious problems. A widely used type of solution is one which contains sulfuric acid and large amounts of chromic acid. This type of solution is effective in cleaning the aluminum alloy surfaces, but the presence of hexavalent chromium ($Cr^{+6}$) in the solution complicates the cleaning procedure and greatly increases its cost. Since hexavalent chromium can present a health hazard, extensive safety precautions must be used during the use of the solution. In addition, waste disposal and treatment of large quantities of dilute wash water effluent are complicated and very costly because of the need to strictly limit introduction of hexavalent chromium into the environment.

Hot solutions of strong acids that are chromium free are a possible alternative to currently used chromic acid solutions. These solutions might contain concentrated sulfuric and/or nitric acid and other additives, such as detergents and oxidizers like ferric sulfate. This type of solution would not present safety and environmental problems of the same severity as a chromic acid solution, but the temperature of the solution and the strength of the acids would still involve significant safety and environmental problems. High solution temperatures also increase the cost of the procedure by increasing heating costs. In addition, it would be difficult to obtain by use of such solutions the same slow predictable etch rate that is obtainable using chromic acid solutions. Moreover, hot solutions of strong acids can cause intergranular attack (pitting) on the surfaces of the articles being cleaned and smut formation on such surfaces caused by redeposition of dissolved copper.

U.S. Pat. No. 4,097,342, granted June 27, 1978, to W. E. Cooke et al. discloses an electrolytic cleaning treatment for aluminum stock prior to metal plating. The treatment is carried out under anodic conditions in a high temperature solution of strong acid for the minor part of a minute. For a solution of 37% phosphoric acid and 18% sulfuric acid, a temperature range of 176° to 203° F. is described as satisfactory. Other solutions and temperatures may also be used provided that a dissolving power is maintained similar to that of the phosphoric acid and sulfuric acid solution. Cooke et al. state that ideally the anodic oxide is removed from the aluminum as rapidly as it forms. The cleaning process may also include a nonelectrolytic treatment for one or two seconds in the same or a similar bath before and/or after the electrolytic treatment.

U.S. Pat. No. 2,708,655, granted May 17, 1955, to H. L. Turner discloses a process for removing an oxide film left by a polishing step before anodizing an aluminum article. The process includes immersing the article in a solution of chromic and phosphoric acids or chromic and sulfuric acids. U.S. Pat. No. 2,721,835, granted Oct. 25, 1955, to W. G. Axtell discloses a process for treating an aluminum article prior to painting or enameling. The process includes subjecting the article to electrolytic treatment in a solution of phosphoric and chromic acid. Axtell describes the effect on an oxide layer on the aluminum article as apparently being removing a portion of it and leaving a comparatively spongy layer which is permeated by the solution and dissolves in the subsequently applied coat of paint or enamel. U.S. Pat. No. 3,041,259, granted June 26, 1962, to W. B. Stoddard, Jr. discloses an alkaline electrolytic process for cleaning aluminum without degrading the surface finish.

Processes for forming controlled oxide coatings on aluminum surfaces are disclosed in the Marceau et al. patent cited above, French Patent Application No. 2,360,051, made public on Feb. 24, 1978, and U.S. Pat. No. 3,844,908, granted Oct. 29, 1974, to H. Matsuo et al; U.S. Pat. No. 3,915,811, granted Oct. 28, 1975, to R. A. Tremmel et al.; U.S. Pat. No. 4,022,671, granted May 10, 1977, to T. Asada; U.S. Pat. No. 4,440,606, granted Apr. 3, 1984, to J. H. Powers et al.; U.S. Pat. No. 4,448,647, granted May 15, 1984, to T. N. Gillich et al.; and U.S. Pat. No. 4,452,674, granted June 5, 1984, to T. N. Gillich et al.

The above-cited patents and the prior art that is discussed and/or cited therein should be studied for the purpose of putting the present invention into proper perspective relative to the prior art.

DISCLOSURE OF THE INVENTION

The invention is directed toward cleaning surfaces of an aluminum article. According to an aspect of the invention, the method of cleaning comprises forming an oxide on the surfaces and dissolving the oxide as it forms to deoxidize the surfaces and displace contaminants from the surfaces. This is carried out by anodizing the article in an aqueous solution comprising phosphoric acid to etch the surfaces at a rate of from about 0.0002 to about 0.0005 inch/surface/hour and minimize the thickness of residual oxide on the surfaces to a thickness of from 0 Angstroms to a maximum of about 3000 Angstroms. The method may also include, after anodizing the article, leaving the article in the solution for a period of time sufficiently long to dissolve a substantial portion of the residual oxide on the surfaces but sufficiently short to avoid smut formation on the surfaces.

The desired etch rate and minimizing of residual oxide may be attained over a range of anodizing parameters. In the preferred embodiment, the phosphoric acid concentration of the solution is from about 15 to about 25% by weight, the solution temperature is from about 75° to about 95° F., and the anodizing potential is from about 4 to about 10 volts. An anodizing duration of about 5 to about 10 minutes is suitable for most situations and is generally preferred.

The method of the invention may be used to prepare surfaces of an aluminum article for an anodizing procedure in which a controlled thickness porous oxide coating is formed on the surfaces. In such case, the cleaning procedure described above is a preliminary anodizing procedure and is followed by removing the article from the solution and rinsing the article with water. In most situations, it is preferable to clean the article with an alkaline cleaner before subjecting the article to the preliminary anodizing procedure. When the method includes this step of alkaline cleaning, the preliminary anodizing procedure performs the additional function of serving as a buffer for the final anodizing solution by neutralizing any residual alkaline cleaner on the article.

The method of the invention provides effective cleaning and deoxidation of surfaces of aluminum articles while avoiding the problems discussed above. Since the method may be carried out at relatively low temperatures and the only active ingredient required for the anodizing solution is dilute phosphoric acid, the safety and environmental problems associated with the use of hot solutions and solutions containing chromium and/or strong acids like sulfuric and nitric acid are avoided. The method of the invention provides a slow predictable etch rate comparable to the etch rate achievable by use of chromic acid solutions and has proved to be at least as effective as chromic acid solutions in cleaning and deoxidizing aluminum surfaces. The method of the invention also minimizes intergranular attack and avoids smut formation. Moreover, the method of the invention has the additional advantage of being highly compatible with anodizing procedures for forming oxide coatings, such as the procedure disclosed in the Marceau et al. patent. The racking and power sources used in such coating procedures may also be used with the method of the invention. This ability to use existing facilities enhances the savings produced by lower heating costs and avoidance of health and environmental hazards to make the method of the invention highly economical to carry out.

These and other advantages and features will become apparent from the detailed description of the best mode for carrying out the invention that follows.

BRIEF DESCRIPTION OF THE DRAWINGS

FIG. 3 is a table of etch rate and current density versus solution temperature.

BEST MODE FOR CARRYING OUT THE INVENTION

Figure 2:
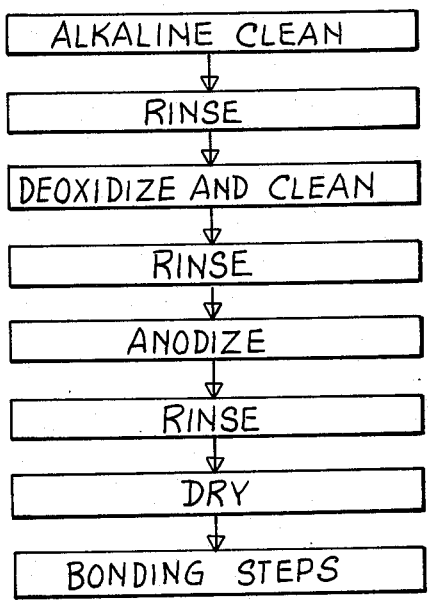
FIG. 2 is a flow diagram of a manufacturing procedure which includes the deoxidizing and cleaning method of the invention.

The best mode of the method of the invention currently known to the applicant is described below and illustrated in the drawings. The flow chart shown in FIG. 2 shows the deoxidizing and cleaning method of the invention as a step in a manufacturing procedure for preparing aluminum articles for structural adhesive bonding. It is anticipated that the primary application of the method of the invention will be as a part of a preparation procedure for adhesive bonding. However, it is of course to be understood that the deoxidation and cleaning method of the invention may also be used to advantage in connection with other manufacturing and article processing procedures.

The method of the invention is a method of cleaning surfaces of an aluminum article to remove undesirable oxidation and contaminants. As used herein, the term "aluminum", refers to pure or nearly pure aluminum as well as aluminum alloys. Examples of aluminum alloys which may be beneficially cleaned by the method of the invention are the alloys known in the aircraft industry as 2024 clad, 2024 bare, and 7075 bare.

In the method of the invention, the article to be cleaned is anodized in an aqueous solution of phosphoric acid. The anodizing parameters are chosen to obtain an etch rate of from about 0.0002 to about 0.0005 inch/surface/hour and to minimize the thickness of residual oxide remaining on the surfaces after the anodizing procedure to a thickness of from 0 Angstroms to a maximum of about 3000 Angstroms. The minimum etch rate is sufficient to ensure thorough removal of various types of contaminants. The maximum etch rate is chosen to avoid excessive reduction of the dimensions of the article being cleaned and to maintain the current draw during the anodizing procedure within the current draw capacity of existing facilities. The minimizing of the thickness of residual oxide ensures that the residual oxide is within tolerable limits for subsequent procedures.

The anodizing solution is a dilute solution of phosphoric acid. No chemical other than phosphoric acid is required to obtain the desired action of the solution. Stronger acids are undesirable because they would increase the etch rate beyond the acceptable limits of the method of the invention. Other chemicals might be added to the solution without adversely affecting its efficacy, but the possible additives currently known to the applicants would not improve the effectiveness of the method. The effect of the presence of contaminants in the solution is discussed further below.

Figure 1:
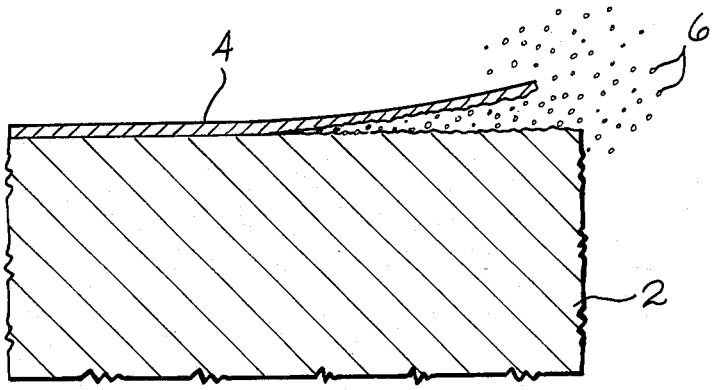
FIG. 1 is a schematic sectional view of an article being cleaning in accordance with the invention.

In laboratory tests, the method of the invention has been shown to be highly effective in cleaning a wide variety of contaminants from aluminum surfaces. In the anodizing procedure of the invention, oxide is formed on the surfaces being cleaned and is dissolved as it forms. This process deoxidizes the surfaces and displaces contaminants therefrom. The displacing of the contaminants apparently is a result of oxide forming under the contaminants around the edges of contaminated areas and continually dissolving to lift the contaminants away from the article. This phenomenon is illustrated in FIG. 1 which shows a surface of an aluminum article 2 with a layer of contamination 4 being cleaned and deoxidized in accordance with the invention. Oxide 6 is continually forming under the layer of contaminant 4 and dissolving to lift the layer 4 away from the article 2.

FIG. 2 is a flow chart of a manufacturing procedure for adhesively bonding an aluminum article in a structure, including steps for preparing the article for bonding. The actual bonding steps are combined in the last item of the flow chart and may be varied according to the needs of a particular situation. The preparatory steps preceding the bonding steps include the deoxidation and cleaning process of the invention and a subsequent anodizing procedure for forming a controlled thickness porous oxide coating on the surfaces to be bonded. An example of the latter anodizing procedure is disclosed in the Marceau et al. patent cited above. It is anticipated that the primary application of the method of the invention will be as a preliminary deoxidizing and cleaning procedure for the type of anodizing disclosed by Marceau et al. The method of the invention is expected to replace the deoxidizing procedures disclosed by Marceau et al.

As shown in FIG. 2, the deoxidizing and cleaning method of the invention is generally preceded by alkaline cleaning and rinsing of the aluminum article. Depending on the type and degree of contamination, the article may also be cleaned with a solvent and/or subjected to vapor degreasing before the alkaline cleaning.

In the article preparation procedure shown in FIG. 2, the article is generally removed from the preliminary anodizing solution of the invention immediately at the end of the desired deoxidizing period. No additional steps to reduce the thickness of the residual oxide on the cleaned surfaces below the maximum of about 3000 Angstroms are required since the subsequent anodizing procedure can easily accommodate the thickness and type of residual oxide left by the deoxidizing and cleaning method of the invention. However, when the method of the invention is used in conjuntion with other types of subsequent procedures, it may be desirable to further reduce the thickness of the residual oxide before carrying out the subsequent procedure. In such cases, following the anodizing of the article in accordance with the invention, the article is preferably left in the solution for a period of time sufficiently long to dissolve a substantial portion of the residual oxide on the surfaces but sufficiently short to avoid smut formation on the surfaces. An example of a suitable period of time for leaving the article in the solution is about 30 seconds.

The parameters of the anodizing procedure of the invention may be varied without departing from the desired etch rate of from about 0.0002 to about 0.0005 inch/surface/hour and without increasing the thickness of the residual oxide beyond the maximum of 3000 Angstroms. The preferred range of parameters includes a phosphoric acid concentration of from about 15 to about 25% by weight, a solution temperature of from about 75° to about 95° F., and an anodizing potential of from about 4 to about 10 volts. A time period of from about 5 to about 10 minutes is generally suitable. The low voltage DC current is applied to the phosphoric acid solution with an initial voltage ramp-up time of about 1 minute. The current density is generally in the range of about 300 coulombs/$dm^2$.

FIG. 3 is a chart showing the etch rate, initial current density, and final current density as a function of solution temperature when the other parameters include a 20% phosphoric acid solution concentration, a 5 volt potential, a 60 second ramp-up time, and a 10 minute anodize time. As expected, the etch rate increases with temperature. The chart includes figures for three types of aluminum alloys. As can be seen, when other parameters remain constant, a higher temperature is required to obtain a given etch rate for clad aluminum alloys than for bare aluminum alloys.

Figure 4:
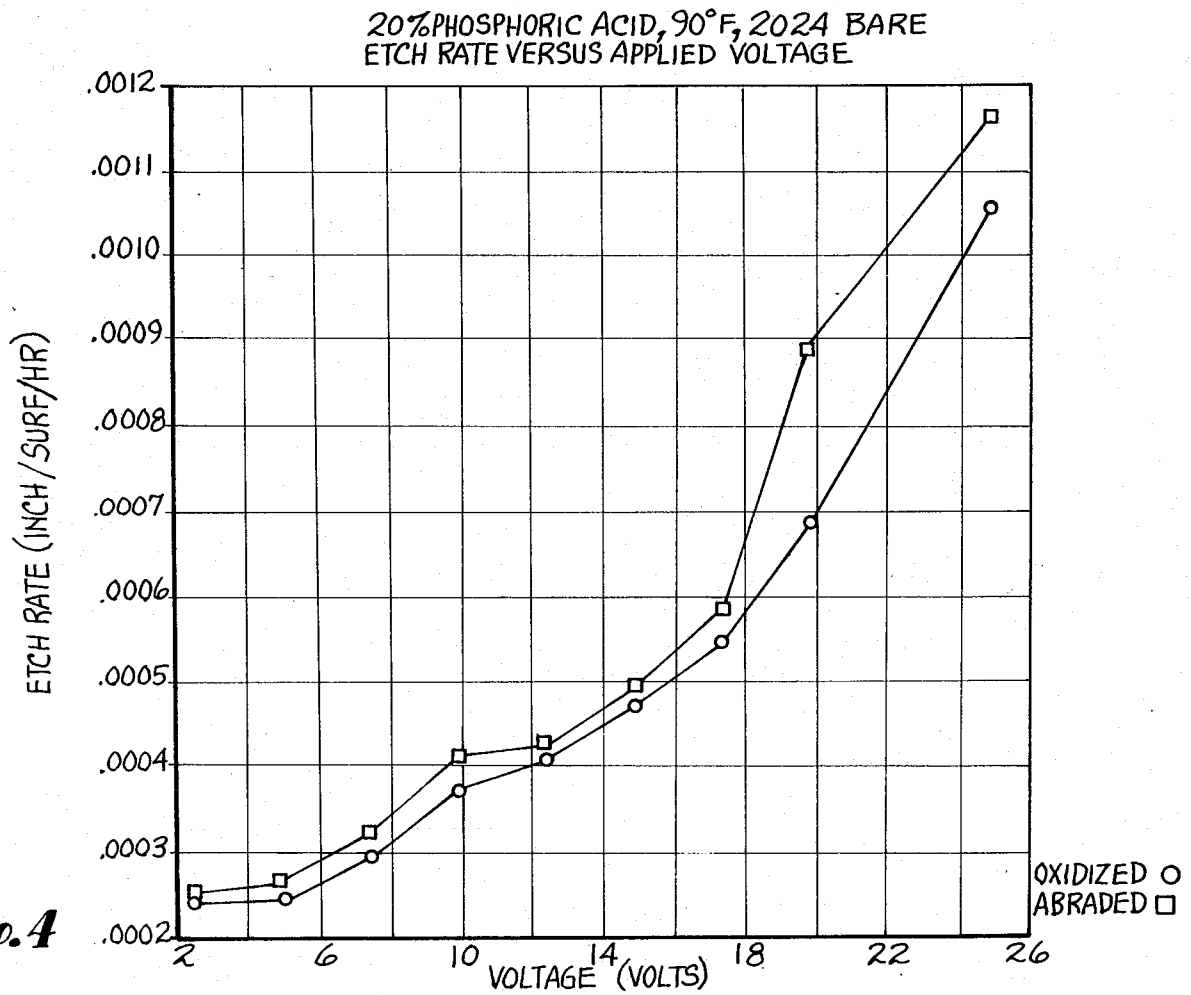
FIG. 4 is a graph of etch rate versus voltage.

FIG. 4 is a graph of etch rate versus voltage for the method of the invention when the phosphoric acid concentration is 20%, the solution temperature is 90° F., and the alloy being cleaned is 2024 bare aluminum alloy. The values shown in FIG. 4 were obtained using a cleaning procedure with a duration of 10 minutes and a one minute ramp-up time. The values represented by a circle were obtained using oxidated titanium clips to hold the aluminum sample coupons, and the values represented by a square were obtained using abraded titanium clips. The graph in FIG. 4 clearly shows that etch rate increases with voltage. Another factor that must be considered when choosing the voltage level for a particular situation is that the thickness of the residual oxide tends to increase with increasing voltage.

Figures 5, 6:
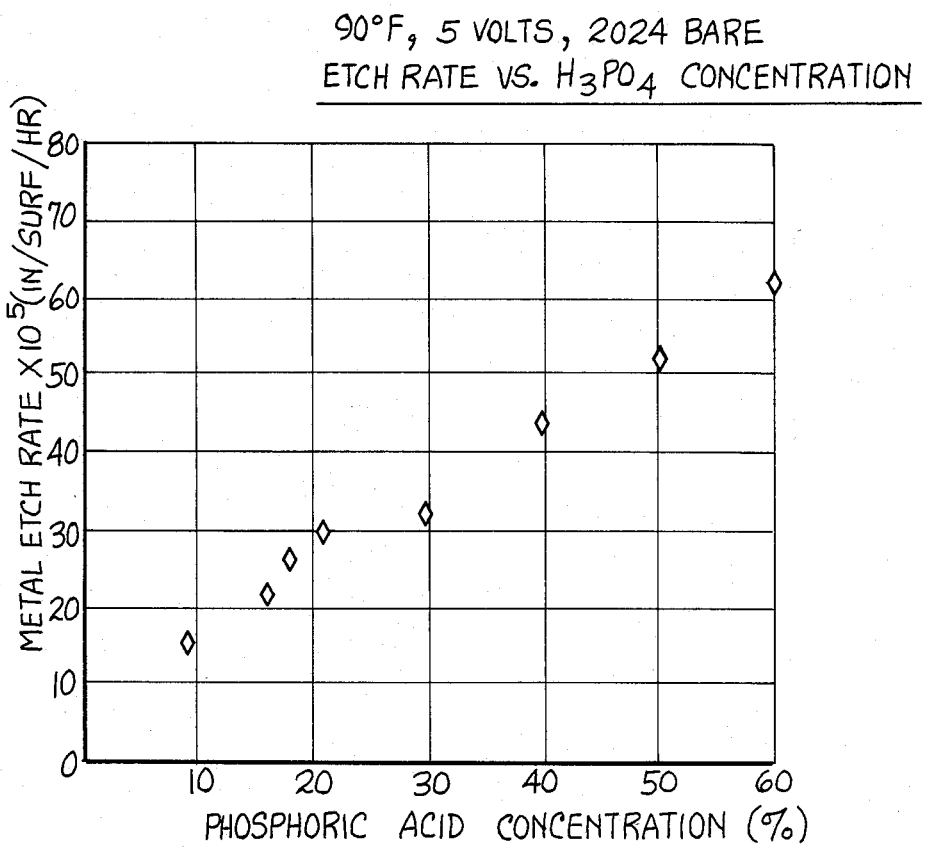
FIG. 5 is a graph of etch rate versus acid concentration.
FIG. 6 is a table illustrating the effect of solution condition on the etch rate.

FIG. 5 is a graph showing etch rate versus phosphoric acid concentration. The values shown in FIG. 5 were obtained using a solution temperature of 90° F., a potential of 5 volts, a ramp-up time of 1 minute, and an immersion time of 10 minutes. The articles being cleaned were 6 inch square, 0.020 inch thick specimens of 2024 bare aluminum. FIG. 5 shows the expected increase in etch rate with increasing acid concentration.

As noted above, the only active ingredient required for the anodizing solution of the invention is phosphoric acid. In order to test the effect of the presence of contamination in the solution due to aging of the solution, experiments were conducted in which high concentrations of aluminum and common alloying elements were added to the solution to artificially age the solution. The amounts of dissolved metal added corresponded to the predicted equilibrium concentrations. FIG. 6 is a table showing the etch rates for three types of alloys for both fresh and aged solutions. The etch rates were obtained using a solution temperature of 90° F., a phosphoric acid concentration of 20%, and a 5 volt potential. The results show that the etch rate is not affected by aging of the solution. The final bond quality and the throwing power of the solution have also been found to be unaffected by aging of the solution. These results clearly indicate that the efficacy of the method is unaffected by the predicted equilibrium concentrations of dissolved metals, and solution life is not limited by dissolved metal concentrations. The long solution life in turn increases the efficiency and cost effectiveness of the method of the invention.

The results of comparative testing between the solution of the invention and a chromic acid solution are set forth below. The chromic acid solution is designated "Solution 1" and has the following composition: 4.1–12.0 ounce/gallon of $Na_2Cr_2O_7$ $2H_2O$, and 38.5–41.5 ounce/gallon of $H_2SO_4$. The operating temperature of Solution 1 is 150° to 160° F. Unless otherwise specified, the parameters for the solution of the invention in each of the examples listed below include a solution concentration of 20% $H_3PO_4$, an operating temperature of 90° F., an applied voltage of 5 volts, an initial voltage ramp-up time of one minute, and an immersion time of 10 minutes; and each specimen was solvent cleaned, vapor degreased, and alkaline cleaned prior to deoxidation.

EXAMPLE 1

A wedge crack extension test of the type illustrated in FIG. 7 of the Marceau et al. patent was conducted on nine test panels, three each of 2024 bare, 2024 clad, and 7075 bare aluminum. One panel of each alloy was deoxidized using Solution 1. Two panels of each alloy were deoxidized in accordance with the invention. Following deoxidized all of the test panels were anodized and bonded by standard procedures of the type described by Marceau et al. Each of the panels was subjected to a wedge crack extension test. The results showed no difference in crack growth between the panels deoxidized with Solution 1 and the panels deoxidized with the phosphoric acid solution of the invention.

EXAMPLE 2

Three Bell peel test panels were fabricated using the phosphoric acid solution of the invention as a deoxidizer. The Bell peel test is standard in the aircraft industry and is a form of a floating roller peel test. There was one panel of each of the three above-listed alloys. All of the three test panels exhibited 100% cohesive failure in the adhesive under both wet and dry conditions.

The results of the wedge crack extension test and the Bell peel test indicate that the adhesive bond quality obtained following phosphoric acid anodizing to provide an oxide coating is the same whether the solution of the invention or Solution 1 is used as the preliminary deoxidizer. It also appears that the final oxide obtained by the anodizing coating procedure is identical whether Solution 1 or phosphoric acid is used as a deoxidizer. Photomicrographs of specimens prepared by phosphoric acid anodizing after Solution 1 deoxidizing and specimens prepared after phosphoric acid deoxidizing confirm this conclusion.

EXAMPLE 3

Two sets of three heavily oxidized 2024 bare panels were chosen. One panel of each set was alkaline cleaned and deoxidized in accordance with the invention, another was alkaline cleaned and deoxidized with Solution 1, and the third was left untreated. The results showed no difference between the panels deoxidized with phosphoric acid and those deoxidized with Solution 1.

EXAMPLE 4

A 2024 bare panel which was coated with cured resin was alkaline cleaned. A portion of the panel was cleaned with Solution 1, and another portion in accordance with the invention. The resin separated from the portion of the panel cleaned in accordance with the invention in fairly large sections. Apparently an oxide formed between the resin and the aluminum and then dissolved. Solution 1 reduced the thickness of the resin but was unable to separate sections of the resin from the panel. The portion of the panel cleaned with Solution 1 was still substantially covered with resin following the test.

EXAMPLE 5

Two 2024 bare panels were marked with a permanent ink "X" over which a layer of heavy drill lubricant was wiped. The panels were alkaline cleaned. One panel was deoxidized in accordance with the invention for four minutes, after which the panel was completely clean. The other panel was deoxidized with Solution 1 for ten minutes, after which it still showed traces of ink and lubricant.

EXAMPLE 6

Cross-sectional surfaces of ¾ inch square extruded 2024 aluminum were polished with 3 micron diamond paste to provide a smooth starting surface. Two of the surfaces were then deoxidized in accordance with the invention for 20 and 30 minutes respectively. Two other surfaces were deoxidized with Solution 1 for the same time periods. The specimens were then sectioned and photographed at 100X magnification to compare intergranular attack and end grain pitting. The pits and depressions visible along the edges of the specimens deoxidized with Solution 1 appeared more numerous and larger than those in the specimens treated in accordance with the invention. Neither deoxidizer produced intergranular attack beyond the tolerable standards of the aircraft industry.

EXAMPLE 7

Experiments were conducted to test the throwing power of the phosphoric acid deoxidizing solution. Throwing power is the ability of the solution to project the applied potential field to areas of parts being anodized not directly facing a cathode and further shielded by parts which are drawing off current. In a production environment, throwing power must be sufficient to suitably clean areas on parts in multiple racks which are shadowed by other details and have large point to cathode distances.

Three 8 inch by 8 inch by 0.010 inch 2024 bare aluminum plates were placed in the solution of the invention with less than one inch separation between the plates. The plates were anodized for 10 minutes at 5 volts and 90° F. The etch rate of each plate was then calculated to provide an estimate of the throwing power of the solution. The calculated etch rates were 0.000184, 0.000185, and 0.000191 inch/surface/hour for the outside, middle, and outside panels, respectively. These results indicate that the phosphoric acid solution has sufficient throwing power for large scale production. The results were obtained in a 70 liter tank equipped with 3.3 square feet of stainless cathode.

EXAMPLE 8

Sheets of 2024 bare aluminum 3 inches by 6 inches were deoxidized in accordance with the invention. The sheets were then hard anodized in a chromic acid solution and sealed to obtain a hard, abrasion resistant oxide coating approximately 30,000 Anstroms thick. Control panels were also anodized after being deoxidized with Solution 1 chromic acid deoxidizer. The appearance of the two groups of test panels were equivalent, and corrosion after 168 hours of neutral salt spray exposure was equivalent. These results indicate that the deoxidizing procedure of the invention is appropriate for hard anodizing processes, such as chromic acid anodizing and sulfuric acid anodizing, as well as the type of phosphoric acid anodizing described by Marceau et al.

The deoxidizing method of the invention is particularly advantageous when used with a subsequent phosphoric acid anodizing procedure of the type disclosed by Marceau et al. The results of the tests done to date indicate that the electrical current requirements of the deoxidizing procedure of the invention are compatible with presently available facilities for subsequent phosphoric acid anodizing. In addition, both procedures require electrical connections to the part. Therefore, once the parts have been placed on racks and electrical contacts to the parts have been made for the preliminary deoxidizing step, there is no need to unload and reload the parts for the subsequent anodizing step. The same rack and electrical contact arrangement may be used for both procedures. This reduces the cost of the overall manufacturing process by reducing equipment requirements and increasing the speed of operation. In addition, the preliminary deoxidizing procedure can serve as a trial run of the part arrangement and electrical contacts for the subsequent more critical anodizing procedure. Inadequate electrical connections can be detected during the deoxidizing procedure and corrected prior to the subsequent anodizing.

Another advantage of the method of the invention in an overall system using phosphoric acid anodizing is that the deoxidizing tank provides a buffer tank of a similar composition to the final anodizing tank. The deoxidizing solution can assimilate and neutralize any alkaline residue that might be carried over from the alkaline cleaning tank. Moreover, since the deoxidizing solution is of similar chemical composition to the anodizing solution, the undesirable chemical species that are carried over into the anodizing tank are minimized.

It will be obvious to those skilled in the art to which this invention is addressed that the invention may be used to advantage in a variety of situations. Therefore, it is also to be understood by those skilled in the art that various changes, modifications, and omissions in form and detail may be made without departing from the spirit and scope of the invention as defined by the following claims.

What is claimed is:

1. A method of cleaning surfaces of an aluminum article, comprising subjecting the article to electrolytic action by making it anodic in an aqueous solution comprising phosphoric acid to etch said surfaces at a rate of from about 0.0002 to about 0.0005 inch/surface/hour, to form an oxide on said surfaces and dissolve the oxide as it forms to deoxidize said surfaces and displace contaminants from said surfaces, and to minimize the thickness of residual oxide on said surfaces to a thickness of from 0 Angstroms to a maximum of about 3000 Angstroms.

2. A method as recited in claim 1, further comprising, after subjecting the article to said electrolytic action, leaving the article in said solution for a period of time sufficiently long to dissolve a substantial portion of the residual oxide on said surfaces but sufficiently short to avoid smut formation on said surfaces.

3. A method as recited in claim 1, in which the phosphoric acid concentration of said solution is from about 15 to about 25% by weight, the solution temperature is from about 75° to about 95° F., and the electrolytic potential is from about 4 to about 10 volts.

4. A method as recited in claim 3, in which said electrolytic action is carried out over a time period of from about 5 to about 10 minutes.

5. A method of treating surfaces of an aluminum article, comprising:

cleaning said surfaces including subjecting the article to electrolytic action by making it anodic in an aqueous solution comprising phosphoric acid to etch said surfaces at a rate of from about 0.0002 to about 0.0005 inch/surface/hour, to form an oxide on said surfaces and dissolve the oxide as it forms to deoxidize said surfaces and displace contaminants from said surfaces, and to minimize the thickness of residual oxide on said surfaces to a thickness of from 0 Angstroms to a maximum of about 3000 Angstroms;

removing the article from said solution and rinsing the article with water; and anodizing the article to form a controlled thickness oxide coating on said surfaces.

6. A method as recited in claim 5, in which the phosphoric acid concentration of said solution is from about 15 to about 25% by weight, the solution temperature is from about 75° to about 95° F., and said electrolytic action is carried out at from about 4 to about 10 volts.

7. A method as recited in claim 6, in which said electrolytic action is carried out over a time period of from about 5 to about 10 minutes.

8. A method as recited in claim 5, further comprising, before subjecting the article to said electrolytic action, cleaning the article with an alkaline cleaner.

9. A method as recited in claim 1, in which said aqueous solution consists essentially of an aqueous solution of phosphoric acid.

10. A method as recited in claim 9, in which the phosphoric acid concentration of said solution is from about 15 to about 25% by weight, the solution temperature is from about 75° to about 95° F., and the electrolytic potential is from about 4 to about 10 volts.

11. A method as recited in claim 5, in which said aqueous solution consists essentially of an aqueous solution of phosphoric acid.

12. A method as recited in claim 11, in which the phosphoric acid concentration of said solution is from about 15 to about 25% by weight, the solution temperature is from about 75° to about 95° F., and said electrolytic action is carried out at from about 4 to about 10 volts.

13. A method of preparing surfaces of an aluminum article for an adhesive bonding procedure, comprising:

cleaning said surfaces including subjecting the article to electrolytic action by making it anodic in an aqueous solution comprising phosphoric acid to etch said surfaces at a rate of from about 0.0002 to about 0.0005 inch/surface/hour, to form an oxide on said surfaces and dissolve the oxide as it forms to deoxide said surfaces and displace contaminants from said surfaces, and to thereby leave said surfaces substantially clean and limit residual oxide on said surfaces to oxide of a type and thickness that can be accommodated in a subsequent anodizing procedure for forming a porous coating on said surfaces;

removing the article from said solution and rinsing the article with water; and then, subjecting the article to an anodizing procedure in which a controlled thickness porous oxide coating is formed on said surfaces to provide a base for an adhesive bond.

14. A method as recited in claim 13, in which the phosphoric acid concentration of said solution is from about 15 to about 25% by weight, the solution temperature is from about 75° to about 95° F., and said electrolytic action is carried out at from about 4 to about 10 volts.

* * * * *